US009506163B2

(12) United States Patent
Hatta et al.

(10) Patent No.: US 9,506,163 B2
(45) Date of Patent: Nov. 29, 2016

(54) METHOD OF ELECTROPLATING WITH SN-ALLOY AND APPARATUS OF ELECTROPLATING WITH SN-ALLOY

(71) Applicant: MITSUBISHI MATERIALS CORPORATION, Tokyo (JP)

(72) Inventors: Takeshi Hatta, Sanda (JP); Akihiro Masuda, Sanda (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 137 days.

(21) Appl. No.: 14/375,041

(22) PCT Filed: Feb. 12, 2013

(86) PCT No.: PCT/JP2013/053248
§ 371 (c)(1),
(2) Date: Jul. 28, 2014

(87) PCT Pub. No.: WO2013/122046
PCT Pub. Date: Aug. 22, 2013

(65) Prior Publication Data

US 2015/0034489 A1 Feb. 5, 2015

(30) Foreign Application Priority Data

Feb. 14, 2012 (JP) ..... 2012-029998

(51) Int. Cl.

| | |
|---|---|
| ***C25D 17/00*** | (2006.01) |
| ***C25D 3/60*** | (2006.01) |
| ***C25D 21/18*** | (2006.01) |
| ***C25D 17/02*** | (2006.01) |
| ***C25D 21/14*** | (2006.01) |
| ***C25D 3/56*** | (2006.01) |

(52) U.S. Cl.
CPC ..... *C25D 17/02* (2013.01); *C25D 3/56* (2013.01); *C25D 3/60* (2013.01); *C25D 17/002* (2013.01); *C25D 21/14* (2013.01); *C25D 21/18* (2013.01)

(58) Field of Classification Search
CPC ..... C25D 17/002; C25D 3/30; C25D 3/32; C25D 3/60
USPC ..... 205/241, 252–254, 300–304
See application file for complete search history.

(56) References Cited

U.S. PATENT DOCUMENTS

2005/0121317 A1 6/2005 Klocke et al.
2006/0032758 A1* 2/2006 Klocke ..... C23C 18/1632 205/219

FOREIGN PATENT DOCUMENTS

JP 2000-219993 A 8/2000
JP 2005-139474 A 6/2005

OTHER PUBLICATIONS

Translation of JP 2005-139474 of Haga et al, published Jun. 2, 2005.*
International Search Report dated Apr. 2, 2013, issued for PCT/JP2013/053248.
Office Action, dated Feb. 16, 2016, issued for the corresponding Chinese patent application No. 201380008134.1.

* cited by examiner

*Primary Examiner* — Nicholas A Smith
*Assistant Examiner* — Brian W Cohen
(74) *Attorney, Agent, or Firm* — Locke Lord LLP; James E. Armstrong, IV; Julie Tabarovsky

(57) ABSTRACT

To provide a method of electroplating with Sn-alloy in which a problem of deposition of metals on an anode when electroplating with Sn-alloy such as Sn—Ag based-alloy or the like is performed is solved and a soluble anode is enabled to be used. Dividing an inside of a plating tank into a cathode cell and an anode cell by an anion-exchange membrane; supplying plating solution including Sn ions to the cathode cell; supplying acid solution to the anode cell; electroplating by energizing an object to be plated in the cathode cell and an anode made of Sn in the anode cell; and using the acid solution including Sn ions liquated out form the anode made of Sn along with progress of plating as replenishing solution of Sn ions for plating solution in the cathode cell.

3 Claims, 1 Drawing Sheet

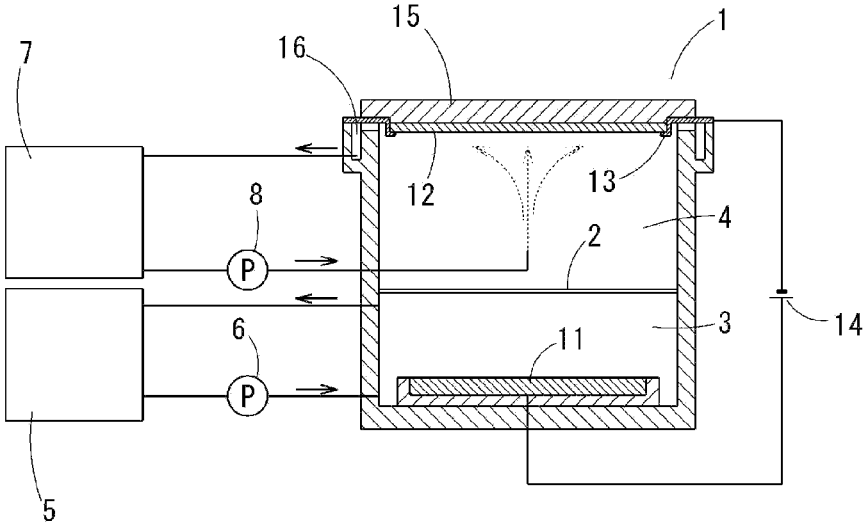
15
1
7
16
12
13
8
4
2
P
3
14
6
11
P
5

METHOD OF ELECTROPLATING WITH SN-ALLOY AND APPARATUS OF ELECTROPLATING WITH SN-ALLOY

TECHNICAL FIELD

The present invention relates to a method and an apparatus of electroplating a substrate to be processed with Sn-alloy such as Sn—Ag based-alloy, Sn—Cu based-alloy or the like.

Priority is claimed on Japanese Patent Application No. 2012-29998, filed Feb. 14, 2012, the content of which is incorporated herein by reference.

BACKGROUND ART

In mounting of a semiconductor device, it is frequently used to connecting a discrete semiconductor device to a circuit substrate using a solder bump. As the solder bump, in recent years, along with propulsion of Pb-free, solder such as Sn—Ag based-alloy and the like are used instead of Sn—Pb based-alloy solder.

When electroplating with Sn—Ag based-alloy, if Sn is used for an anode, Ag is substitution-deposited on an anode surface since Ag is nobler than Sn. In order to prevent this, it is frequent to use an insoluble anode such as Pt and the like for electroplating. However, electrolysis may be deteriorated since hydrogen is generated on the anode surface. Accordingly, it is contrived not to substitution-deposit Ag in the soluble anode.

Patent Document 1 discloses that when an object to be plated is soaked in a lead-free tin-alloy electroplating bath in an electroplating tank so that electroplating is performed in a state in which the object to be plated is a cathode, electroplating is performed in the plating tank in a state in which the anode is isolated by an anode bag or a box formed by a cation-exchange membrane. According to this method, Sn ions in plating solution in the anode box are moved to the plating tank through the exchange membrane, so that the Sn ions are stably supplied. Therefore, even if a soluble anode such as Sn and the like is used as an anode, by movement of cations, deposition of metals with respect to an anode can be prevented.

PRIOR ART DOCUMENTS

Patent Document

Patent Document 1: Unexamined Japanese Patent Application, First Publication No. 2000-219993

SUMMARY OF INVENTION

Problem to be Solved by Invention

While energizing for electroplating, the deposition of metals on the anode can be prevented by an effect of the cation-exchange membrane. However, when in a non-energized state and the electroplating is not performed, substitution-deposition is occurred on the anode in a state in which the object to be plated and the anode are soaked in the plating solution. Therefore, in the non-energized state, it is necessary to take a step for pulling up the anode.

The present invention is achieved in consideration of the above circumstances, and provides a method of electroplating with Sn-alloy and an apparatus of electroplating with Sn-alloy in which a problem of deposition of metals on an anode when electroplating with Sn-alloy such as Sn—Ag based-alloy or the like is performed is solved and a soluble anode is enabled to be used.

Means for Solving the Problem

A method of electroplating with Sn alloy of the present invention is characterized by including: dividing an inside of a plating tank into a cathode cell and an anode cell by an anion-exchange membrane; supplying plating solution including Sn ions to the cathode cell; supplying acid solution to the anode cell; electroplating by energizing an object to be plated in the cathode cell and an anode made of Sn in the anode cell; and using the acid solution including Sn ions liquated out form the anode made of Sn along with progress of plating as replenishing solution of Sn ions for the plating solution in the cathode cell.

In the cathode cell, Sn-alloy is deposited on the object to be plated by electrolyzing; meanwhile, in the anode cell, Sn ions are supplied into solution from the anode. With progressing of the electrolyzing, concentration of Sn ions in the plating solution in the cathode cell is decreased but concentration of free acid is increased. On the other hand, in the anode cell, concentration of Sn ions is increased but concentration of free acid is decreased. Since the cathode cell and the anode cell are parted by the anion-exchange membrane, the free acid can be moved but Sn ions cannot pass through. Therefore, with progressing of the electrolyzing, the concentration of free acid in the cathode cell and the concentration of free acid in the anode cell are balanced, and then, a balanced state is maintained. By setting volume of the cells and the like so that an increase of the concentration of free acid at the cathode cell side is dominant on a descent of the concentration of free acid at the anode cell side, total concentration of free acid is increased with balance. When the concentration of free aced in the cathode cell reaches a prescribed value, the plating is terminated.

At this time, the solution in the anode cell includes Sn ions with high concentration, so that it can be used as replenishing solution of Sn ions for the plating solution. That is to say, in this method of plating, as performing plating with Sn alloy on the object to be plated in the cathode cell, the replenishing solution can be generated for the plating solution including Sn ions in the anode cell. Moreover, since it is divided by the anion-exchange membrane, metal ions such as Ag ions and the like in the plating solution cannot move from the cathode cell to the anode cell, so that substitution deposition is not occurred on the anode made of Sn.

In the method of electroplating with Sn-alloy of the present invention, it is preferable that the cathode cell be set to have a larger volume than that of the anode cell.

In the method of electroplating with Sn-alloy of the present invention, it is preferable that the acid solution in the anode cell have a same composition as that of acid included in the plating solution in the cathode cell.

An apparatus of electroplating with Sn-alloy of the present invention is characterized in that an inside of a plating tank is divided to a cathode cell in which an object to be plated is disposed and an anode cell in which an anode made of Sn is disposed by an anion-exchange membrane.

In the apparatus of electroplating with Sn alloy of the present invention, it is preferable that the cathode cell be set to have a larger volume than that of the anode cell.

In the apparatus of electroplating with Sn alloy of the present invention, it is preferable that the anion-exchange membrane be horizontally provided at a middle position in an up-and-down direction of the plating tank; and the cathode cell and the anode cell be parted to an upper part and a lower part in the plating tank so as to dispose the cathode cell on the anode cell.

Effect of Invention

According to the present invention, since the inside of the plating tank is divided by the anion-exchange membrane, the deposition of metals on the anode made of Sn is not occurred. Furthermore, as performing plating with Sn-alloy on the object to be plated in the cathode cell, the replenishing solution can be generated for the plating solution including Sn ions in the anode cell. Therefore, a replenishing solution which is separately produced hitherto can be reduced, so that a cost can be reduced.

BRIEF DESCRIPTION OF DRAWINGS

FIG. 1 It is a schematic structure view showing an embodiment of an apparatus of electroplating with Sn-alloy of the present invention.

DESCRIPTION OF EMBODIMENT

Below, an embodiment of a method of electroplating with Sn-alloy and an apparatus of electroplating with Sn-alloy according to the present invention will be explained referring drawings.

FIG. 1 shows an embodiment of an apparatus with Sn alloy of electroplating of the present invention. In this apparatus of electroplating with Sn-alloy, since an anion-exchange membrane 2 is horizontally provided at a middle position in an up-and-down direction of a plating tank 1, an inside of the plating tank 1 is divided to an upper part and a lower part, so that a space under the anion-exchange membrane 2 is an anode cell 3 and a space over the anion-exchange membrane 2 is a cathode cell 4.

The anode cell 3 stores acid solution inside and is connected to a tank 5 which is separately provided, so that the acid solution can be circulated by a pump 6. The cathode cell 4 stores plating solution inside and is connected to a tank 7 which is separately provided as well as the anode cell 3, so that the plating solution can be circulated by a pump 8.

At a bottom part of the anode cell 3, an anode 11 made of Sn having a circular-plate shape for example is horizontally provided. Above the cathode cell, a work-holding part 13 is provided so as to hold a wafer 12 (i.e., an object to be plated) horizontally being mounted thereon. At the work-holding part 13, an electrode is provided so as to be in contact with the wafer 12 when holding the wafer 12. This is a structure for electroplating the wafer 12 as a cathode by connecting a power source 14 between the electrode of the work-holding part 13 and the anode 11.

In this case, the wafer 12 is disposed horizontally in the vicinity of a liquid surface of the plating solution. The plating solution is supplied from the tank 7 to a lower part of the cathode cell 4 as a jet stream shown by the broken line toward an underside of the wafer 12. A cover body 15 covering over the plating tank 1 acts as a weight upon the wafer 12. The plating solution supplied toward the underside of the wafer 12 is conducted from the plating tank 1 to an overflow passage 16, and returns to the tank 7.

A volume of the cathode cell 4 is set to be larger than that of the anode cell 3. For example, it is preferable that the cathode cell 4 have the volume of two to five times of that of the anode cell 3. As the anion-exchange membrane 2, for example, "Selemion" made by Asahi Glass Co., LTD. can be utilized since it is excellent in acid resistance.

A method performing electroplating with Sn—Ag alloy on the wafer 12 by the plating apparatus configured above will be explained.

As plating solution for Sn—Ag alloy, acid such as alkyl sulfonic acid such as methanesulfonic acid, ethanesulfonic acid, and besides plating metal ions ($Sn^{2+}$, $Ag^{+}$), addition agent such as antioxidant, surfactant and the like, and complexing agent and the like are combined. The plating solution for Sn—Ag alloy utilized in this embodiment is combined as below, for example.

alkyl sulfonic acid; 100 to 150 g/L $Sn^{2+}$; 40 to 90 g/L $Ag^{+}$: 0.1 to 3.0 g/L In the anode cell 3, the same acid as the acid in the plating solution in the cathode cell 4 is used, for example alkyl sulfonic acid of 80 to 150 g/L is stored.

When the wafer 12 is held on the work-holding part 13 of the cathode cell 4 and electric power is supplied, by the electrolyzing, in the cathode cell 4, Sn—Ag alloy is deposited on the underside of the wafer 12 being in contact with the plating solution; and in the anode cell 3, Sn ions ($Sn^{2+}$) are supplied to the acid solution from the anode 11. With progressing of the electrolyzing, in the cathode cell 4, Sn ions and Ag ions in the plating solution are deposited on a surface of the wafer 12 as Sn—Ag alloy, so that concentration of Sn ions is decreased but concentration of free acid is increased in the plating solution. On the other hand, in the anode cell 3, Sn ions are supplied from the anode 11 made of Sn, so that concentration of Sn ions is increased but concentration of free acid is decreased in the acid solution. Since the cathode cell 4 and the anode cell 3 are parted by the anion-exchange membrane 2, Sn ions which are cations cannot pass through the anion-exchange membrane 2 even though the free acid can move through. The plating is progressed in this state, as circulating the plating solution in the cathode cell 4 and the acid solution in the anode cell 3 through the tanks 5 and 7, replenishing solution of metal composition for the plating solution is supplied as necessary.

With progressing of the electrolyzing, since the free acid moves through the anion-exchange membrane 2, the concentration of free aced in the cathode cell 4 and the concentration of free acid in the anode cell 3 are balanced, and then, a balanced state is maintained. As described above, since the volume of the cathode cell 4 is larger than that of the anode cell 3, an increase of the concentration of free acid at the cathode cell 4 side is dominant on a descent of the concentration of acid at the anode cell 3 side, total concentration of free acid is increased with balance.

If the concentration of free acid is increased to more than a prescribed value, quality of a plating film is deteriorated. Therefore, the plating process is terminated when the concentration of free acid reaches 350 g/L, for example. At this time, the solution in the anode cell 3 includes Sn ions at high concentration, for example, concentration of 200 g/L. The plating solution in the cathode cell 4 is replaced with new plating solution. The acid solution stored in the anode cell 3 can be used as replenishing solution of Sn ions for the plating solution since including Sn ions at high concentration.

As above-mentioned, by this plating method, while performing plating with Sn—Ag alloy on the wafer 12 in the cathode cell 4, it is possible to generate the replenishing solution of the plating solution including Sn ions in the anode cell 3. Moreover, since it is divided by the anion-exchange membrane 2, Ag ions included in the plating solution cannot move from the cathode cell 4 to the anode cell 3, so that substitution deposition of Ag on the anode 11 made of Sn is not occurred.

If performing plating anew, plating solution can be supplied to the cathode cell 4 by generating with the above-mentioned combination utilizing the replenishing solution of Sn ions obtained as above; and new acid solution can be supplied to the anode cell 3.

EXAMPLES

Volume of an anode cell was 20 L, volume of a cathode cell was 40 L, and the anode cell and the cathode cell were parted by an anion-exchange membrane of polymer compound. Methanesulfonic acid solution of concentration of 80 g/L was supplied to the anode cell, and composition of plating solution being supplied to the cathode cell was as below.

methanesulfonic acid; 120 g/L $Sn^{2+}$: 80 g/L $Ag^{+}$: 1.5 g/L addition agent; 40 g/L Plating was performed on condition that: bath temperature of a plating tank was set to 25° C.; current density (ASD) was 12 A/dm$^2$; and integrating electrolyte quantity was about 100 AH/L (Ampere Hour per Liter). In the meantime, replenishing solution of Sn ions and replenishing solution of Ag ions were supplied to the cathode cell so as to maintain the above-mentioned composition with analyzing component of the plating solution in the cathode cell along with progressing of plating.

the plating solution in the cathode cell at 100 AH/L was that concentration of free acid was 280 g/L; and concentration of free acid was 280 g/L also in the anode cell. According to measurement of concentration of Sn ions in acid solution in the anode cell, it was 200 g/L.

Metal composition other than Sn was not detected on a surface of the anode.

From this result, it is recognized that solution in which substitution deposition is not occurred even though a soluble anode made of Sn is used and which can be sufficiently used as replenishing solution of Sn ions can be generated along with plating process in parallel.

The present invention is not limited to the above-described embodiments and various modifications may be made without departing from the scope of the present invention.

For example, the plating tank is divided into the upper part and the lower part by the horizontal anion-exchange membrane in the above embodiment, and it may be divided by a vertical anion-exchange membrane into left and right. Moreover, other than the plating with Sn—Ag based-alloy, the present invention can be applied to plating with Sn—Cu based-alloy. It can be applied when plating with alloy of noble metal with respect to Sn.

INDUSTRIAL APPLICABILITY

The present invention can be applied to electroplating with Sn alloy such as Sn—Ag based-alloy, Sn—Cu based-alloy and the like on a substrate to be processed such as a wafer and the like.

DESCRIPTION OF REFERENCE SYMBOLS

1 plating tank
2 anion-exchange membrane
3 anode cell
4 cathode cell
5, 7 tank
6, 8 pump
11 anode made of Sn
12 wafer (object to be plated)
13 work-holding part
14 power source
15 cover body
16 overflow passage

The invention claimed is:

1. A method of electroplating with Sn-alloy comprising:
dividing an inside of a plating tank into a cathode cell and an anode cell by an anion-exchange membrane;
supplying plating solution including Sn ions to the cathode cell;
supplying acid solution to the anode cell;
electroplating by energizing an object to be plated in the cathode cell and an anode made of Sn in the anode cell; and
monitoring total acid concentration in the cathode cell and the anode cell:
terminating the electroplating when the total acid concentration is increased to a prescribed value,
generating a replenishing solution using the acid solution in the anode cell including Sn ions supplied from the anode made of Sn; and
replacing the plating solution in the cathode cell by the replenishing solution; and
supplying new acid solution to the anode cell.

2. The method of electroplating with Sn-alloy according to claim 1, wherein the cathode cell is set to have a larger volume than that of the anode cell.

3. The method of electroplating with Sn-alloy according to claim 1, wherein the acid solution in the anode cell has a same composition as that of acid included in the plating solution in the cathode cell.

* * * * *